United States Patent [19]

Sumikawa

[11] Patent Number: 4,596,518

[45] Date of Patent: Jun. 24, 1986

[54] SWASH-PLATE TYPE COMPRESSOR

[75] Inventor: Seiji Sumikawa, Konan, Japan

[73] Assignee: Diesel Kiki Co., Ltd., Tokyo, Japan

[21] Appl. No.: 695,481

[22] Filed: Jan. 28, 1985

[30] Foreign Application Priority Data

Feb. 3, 1984 [JP] Japan ..... 59-18826
Feb. 3, 1984 [JP] Japan ..... 59-18827

[51] Int. Cl.[4] ..... F04B 1/16; F04B 1/18; F04B 49/00

[52] U.S. Cl. ..... 417/269; 417/270; 417/295; 184/6.17

[58] Field of Search ..... 417/269, 270, 295; 184/6.17

[56] References Cited

U.S. PATENT DOCUMENTS

| | | | |
|---|---|---|---|
| 3,781,135 | 12/1973 | Nickel | 417/295 |
| 3,951,569 | 4/1976 | Jacobs | 417/269 |
| 3,999,893 | 12/1976 | Kishi | 417/269 |
| 4,274,813 | 6/1981 | Kishi | 417/269 |
| 4,326,838 | 4/1982 | Kawashima | 417/269 |
| 4,330,999 | 5/1982 | Nakayama | 417/295 |
| 4,412,787 | 11/1983 | Kondo | 417/269 |
| 4,415,315 | 11/1983 | Shibuya | 417/269 |

FOREIGN PATENT DOCUMENTS

| | | | |
|---|---|---|---|
| 52-96407 | 8/1977 | Japan . | |
| 48005 | 5/1980 | Japan | 417/269 |
| 57-65887 | 4/1982 | Japan . | |

*Primary Examiner*—William L. Freeh
*Attorney, Agent, or Firm*—Frishauf, Holtz, Goodman & Woodward

[57] ABSTRACT

A partition separates a suction passageway axially extending in the compressor main body from a swash plate chamber, and is constructed with a mechanism to introduce a refrigerant medium into the swash plate chamber and toward the swash plate, from a portion of the suction passageway radially outward of the swash plate substantially at a predetermined angle relative to the axis of the drive shaft. Preferably, the compressor includes a delivery control mechanism responsive to pressure in the suction passageway to vary the effective cross-sectional area of the suction passageway.

5 Claims, 9 Drawing Figures

SWASH-PLATE TYPE COMPRESSOR

BACKGROUND OF THE INVENTION

This invention relates to swash-plate type compressors for compressing refrigerant gas in air conditioning systems, and more particularly to improvements in lubricating oil feeding means used in such compressors, which is capable of smoothly introducing lubricating oil contained in the refrigerant gas into the swash plate chamber.

In a swash-plate type compressor of this kind in general, rotation of the swash plate which is obliquely secured on the drive shaft causes reciprocating motions of the pistons within their respective cylinder bores to carry out pumping actions in cooperation with the suction valves and discharge valves. The swash plate and the pistons engage with each other, with balls and shoes slidably interposed therebetween, in a manner such that rotation of the swash plate is smoothly transduced into reciprocating motions of the pistons. According to this arrangement, the swash plate, the shoes, the balls and the pistons have their sliding contact portions subjected to severe friction and therefore require to be always fed with lubricating oil.

To effect lubrication of the sliding contact portions, a swash-plate type compressor has been proposed, e.g. by Japanese Provisional Patent Publication No. 57-65887, which is adapted to introduce part of the suction refrigerant gas into the swash plate chamber accommodating the swash plate, to supply the sliding contact portions with the lubricating oil contained in the refrigerant gas.

With compressors of the above kind, as the rotational speed of the compressor increases, the compressor delivery, i.e. the amount of refrigerant gas discharged from the compressor, increases to enhance the cooling or refrigerating capacity of the associated cooling or refrigerating cycle. Therefore, when the cooling or refrigerating capacity exceeds a desired level, it can result in large energy loss of the compressor and freeze-up of the evaporator. to avoid the disadvantage, a variable delivery type compressor has been proposed, e.g. by Japanese Provisional Patent Publication No. 52-96407, wherein a damper responsive to pressure changes is arranged in the vicinity of the suction port so that when the pressure in the vicinity of the suction port drops during high speed operation of the compressor, the damper is displaced in response to the pressure drop to reduce the cross-sectional area of the flow passage of the suction refrigerant gas, thereby decreasing the delivery of the compressor.

However, even in a compressor employing one or both of these proposed arrangements, in which the lubricating oil contained in the refrigerant gas is used to lubricate the sliding contact portions within the swash plate chamber, introduction of the refrigerant gas into the swash plate chamber is impeded by the swash plate swingingly rotating in the swash plate chamber at a high speed, resulting in an insufficient amount of the refrigerant gas flowing into the swash plate chamber. Further, the amount of the refrigerant gas flowing into the swash plate chamber decreases with an increase in the rotational speed of the compressor. Consequently, these conventional compressors are not free of the disadvantages that only a small amount of the lubricating oil is supplied to the sliding contact portions within the swash plate chamber and in addition, its amount decreases during high speed operation of the compressor wherein the supply of lubricating oil to the sliding contact portions is particularly required.

SUMMARY OF THE INVENTION

It is an object of the invention to provide a swash-plate type compressor which can supply the sliding contact portions within the swash plate chamber with a sufficient amount of the refrigerant gas containing lubricating oil, to thereby achieve improved lubricating performance of the compressor.

It is another object of the invention to provide a variable delivery swash-plate type compressor which can achieve improved lubricating performance of the sliding contact portions in the swash plate chamber even during high speed operation of the compressor.

According to the invention, the swash-plate type compressor has a main body having at least one cylinder bore formed therein and axially extending therethrough in which a piston is received for reciprocating motion, and a suction passageway formed therein and also axially extending therein for communication with the at least one cylinder bore. A swash plate is secured obliquely on a drive shaft which axially extends in and is rotatably supported by the main body. Partition means separates the suction passageway from a swash plate chamber accommodating the swash plate. Refrigerant medium introducing means is arranged on the partition means for introducing a refrigerant medium supplied to the suction passageway from outside and flowing therein, into the swash plate chamber toward the swash plate from a portion of the suction passageway radially outward of the swash plate substantially at a predetermined angle relative to the axis of the drive shaft.

Preferably, the swash-plate type compressor includes delivery control means responsive to pressure in the suction passageway to vary the effective cross-sectional area of the suction passageway.

The above and other objects, features and advantages of the invention will be more apparent from the ensuing detailed description taken in conjunction with the accompanying drawings.

DETAILED DESCRIPTION

Figure 1:
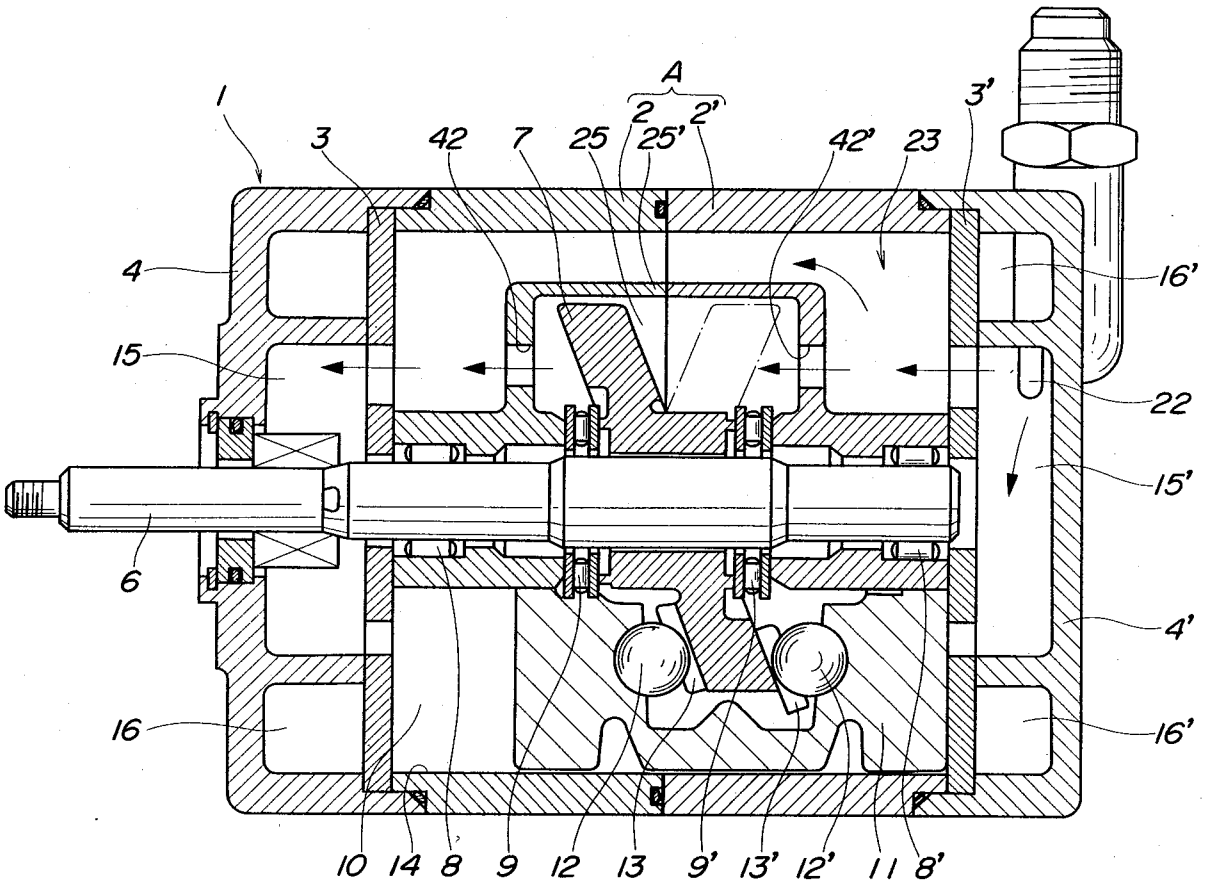
FIG. 1 PRIOR ART
FIG. 1 is a longitudinal sectional view illustrating a conventional swash-plate type compressor.

Referring first to FIG. 1, there is illustrated a conventional swash-plate type compressor disclosed in Japanese Provisional Patent Publication No. 57-65887 referred to hereinbefore. A main body 1 of the compressor comprises a cylinder block A formed by a pair of cylindrical members 2 and 2' combined together in axial alignment, and front and rear side blocks 4 and 4' secured to the opposite outer ends of the cylinder block A via valve plates 3 and 3'. A drive shaft 6 is supported by bearings 8, 8', 9 and 9' for rotation relative to the main body 1, and a swash plate 7 is secured on the drive shaft 6. The cylinder block A is formed therein with a plurality of cylinder bores 10, only one of which is shown, within which double headed pistons 11 are slidably received. The pistons 11 engage the swash plate 7 through balls 12, 12' and shoes 13, 13' so that as the swash plate 7 swingingly rotates with rotation of the drive shaft 6, the pistons 11 reciprocate within the respective cylinder bores 10 to alternately increase and decrease the volume of pump working chambers 14 (only one of which is shown) defined by the valve plates 3, 3', the pistons 11 and the cylindrical members 2, 2'. On this occasion, the shoes 13, 13' slide on the opposite side faces of the swash plate 7.

Defined within the side blocks 4, 4' in cooperation with the valve plates 3, 3' are suction chambers 15, 15' and discharge chambers 16, 16' which are communicated with respective counterparts, respectively, by a suction passageway 23 and a discharge passageway, not shown, both extending through the cylinder block A and the valve plates 3, 3'. A swash plate chamber 25 is defined by a partition member 25' provided in the cylinder block A, and accommodates the swash plate 7. The suction passageway 23 is defined in part by the partition member 25', and is communicated with the swash plate chamber 25 through axial holes 42 and 42' formed in the partition member 25' at its opposite end walls.

A suction port 22 and a discharge port, not shown, are formed in the rear side block 4', and communicate, respectively, with the rear side suction chamber 15' and the rear side discharge chamber 16'.

With this arrangement, the refrigerant gas introduced into the compressor through the suction port 22 first flows into the rear suction chamber 15' and then is delivered to the front suction chamber 15 through the suction passageway 23. While flowing in the suction passageway 23, the refrigerant gas is in part introduced into the swash plate chamber 25 through the rear side hole 42' of the partition member 25' and then flows out of the chamber 25 through the front side hole 42, whereby the swash plate 7 is supplied with lubricating oil which has been separated from the refrigerant gas flowing around the swash plate 7, for lubrication of the sliding contact portions between the swash plate 7, the pistons 11, the balls 12, 12' and the shoes 13, 13'.

According to this conventional swash-plate type compressor, however, it is difficult to supply the swash plate 7 and the sliding contact portions with a sufficient amount of lubricating oil, for the reasons stated hereinbefore.

Figure 2:
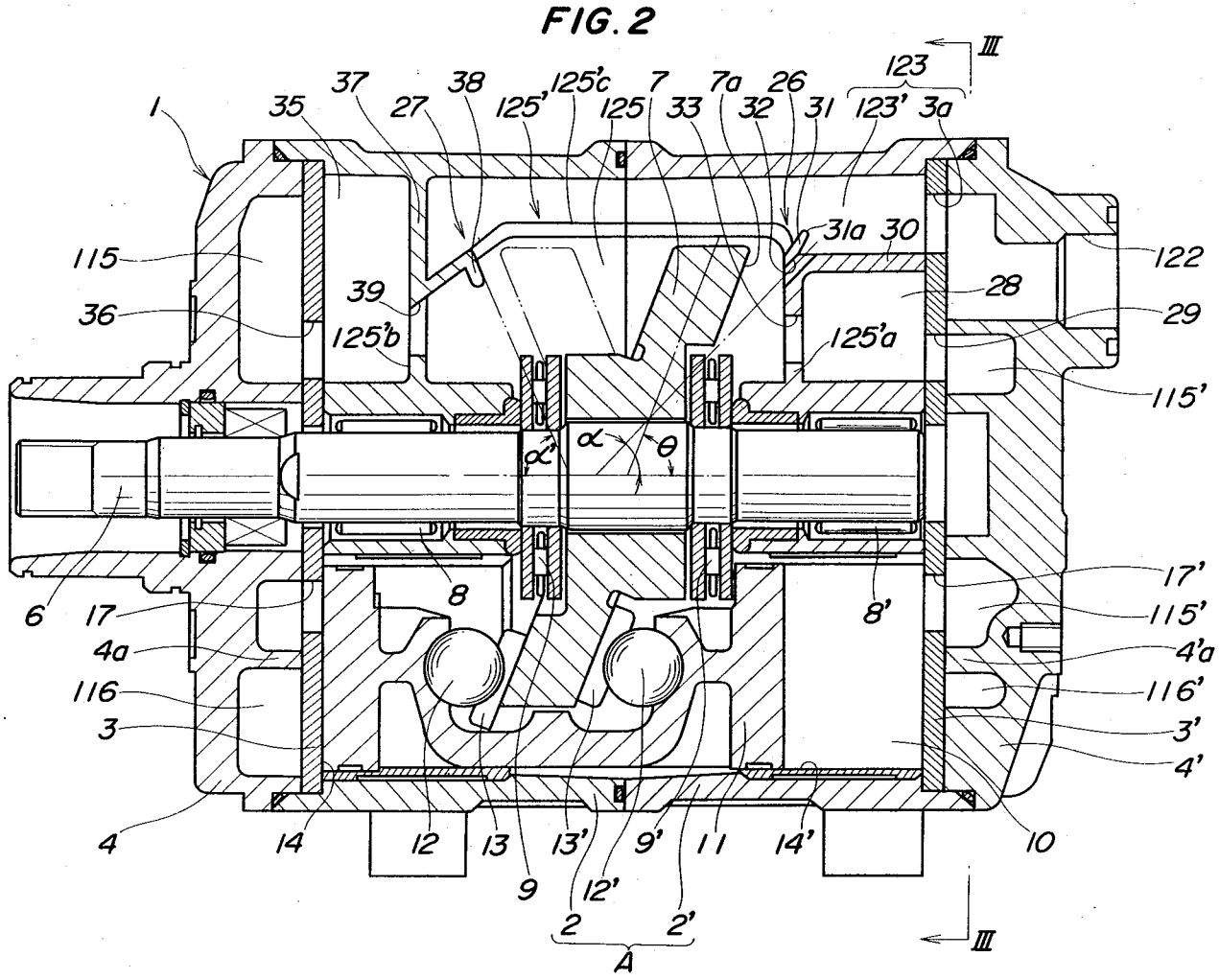
FIG. 2 is a vertical longitudinal sectional view of a swash-plate type compressor according to a first embodiment of the present invention.
Figure 3:
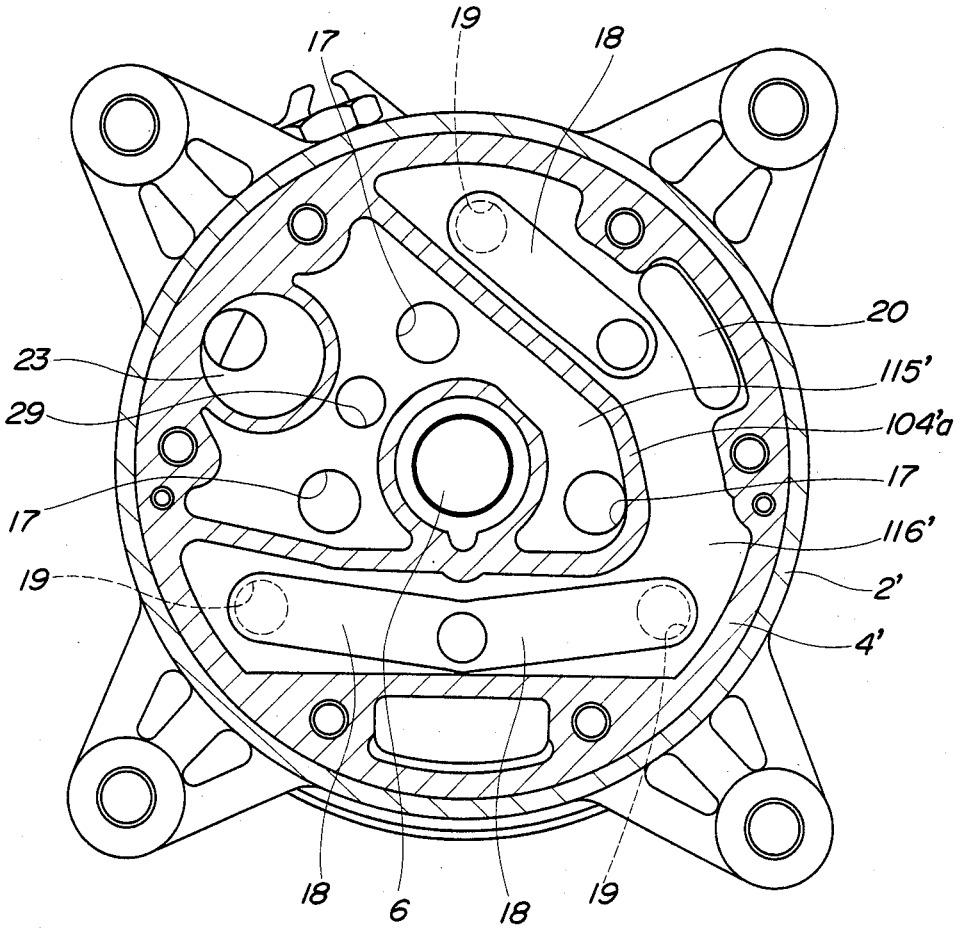
FIG. 3 is a vertical transverse cross-sectional view taken along line III—III in FIG. 2.
Figure 4:
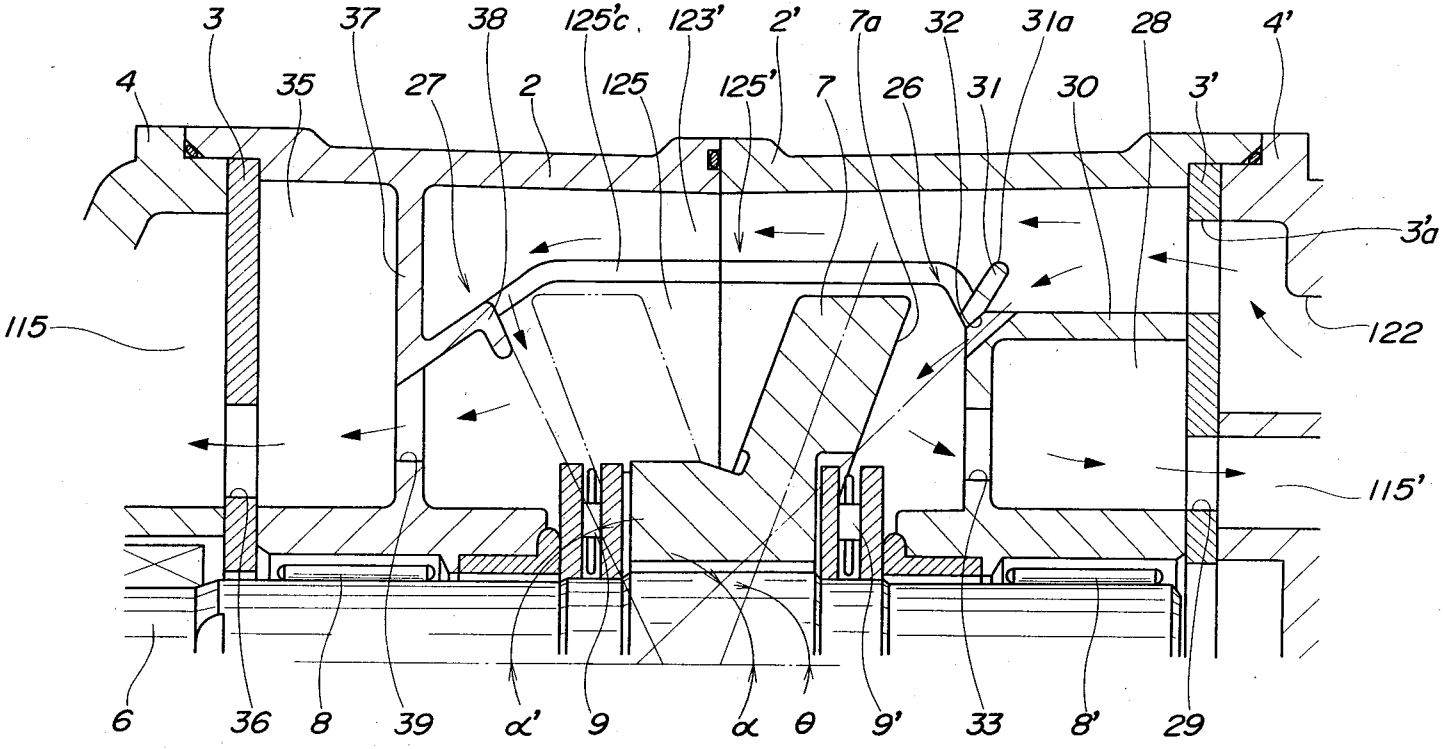
FIG. 4 is a fragmentary enlarged view of the compressor of FIG. 2, showing a flow of a suction refrigerant gas within the compressor.

FIGS. 2 through 4 illustrate a swash-plate type compressor according to a first embodiment of the invention, wherein like reference characters are employed to designate parts and elements identical with those in the conventional compressor shown in FIG. 1, and explanation thereof is therefore partly omitted.

A compressor main body 1 comprises a cylinder block A formed by paired front and rear cylindrical members 2 and 2' combined together in axial alignment, and front and rear side blocks 4 and 4' secured to the opposite outer ends of the cylinder block A via front and rear valve plates 3 and 3'. A drive shaft 6, which is driven by a prime mover, not shown, such as an internal combustion engine, axially penetrates through the front side block 4 and the front valve plate 3 and extends along the axis of the cylinder block A. A swash plate 7 is secured aslant on the drive shaft 6 at an angle $\theta$ relative to the axis of the drive shaft 6. The drive shaft 6 and the swash plate 7 are rotatably supported by the cylinder block A, respectively, via radial bearings 8, 8' and thrust bearings 9, 9' interposed therebetween.

The cylinder block A is formed therein with three cylinder bores 10 (only one of which is shown) axially extending parallel with the drive shaft 6 and circumferentially spaced from each other by an angle of 120 degrees, with their opposite open ends closed by the valve plates 3, 3'. Double headed pistons 11 are received within respective ones of the cylinder bores 10.

Suction chambers 115, 115' and discharge chambers 116, 116' corresponding, respectively, to the elements 15, 15' and 16, 16' in FIG. 1, are defined in the side blocks 4, 4' in cooperation with the valve plates 3, 3,', and separated from each other by partition walls 4*a* and 4*a'* formed in the side blocks 4, 4'. The suction chambers 115, 115' and the discharge chambers 116, 116' are disposed to be communicated with the cylinder bores 10, respectively, through suction openings 17 and 17' formed through the valve plates 3, 3' and their associated suction valves, not shown, and through discharge openings (only one of which is shown in FIG. 3 at 19) formed through the valve plates 3, 3' and their associated discharge valves (only one of which is shown in FIG. 3 at 18). The front and rear discharge chambers 116, 116' are communicated with each other via a discharge passageway 20 (FIG. 3) extending through the cylindrical members 2, 2' and the valve plates 3, 3'.

A suction port 122 and a discharge port, not shown, are formed in the rear side block 4' and connected to an external refrigerating circuit, not shown. The suction port 122 communicates with a suction passageway 123 comprised of a through hole 3'*a* formed in the rear valve plate 3', and a passage 123' formed in the cylindrical members 2, 2', while the discharge port communicates with the rear discharge chamber 116'. The passage 123' is defined within the cylindrical members 2, 2' and in part located above and defined by a peripheral wall of a partition member 125' which is comprised of a pair of half portions formed integrally with the cylindrical members 2, 2' and abuttingly combined with each other at an axially central location of the compressor.

A swash plate chamber 125 is defined by the partition member 125' at an axially central location of the compressor, and has its opposite ends provided with rear and front refrigerant gas introducing means 26 and 27 which communicate the passage 123' with the swash plate chamber 125 for introducing the refrigerant gas delivered to the suction passageway 123 into the swash plate chamber 125. The refrigerant gas introducing means 26, 27 are constructed such that the suction refrigerant gas is introduced into the swash plate chamber 125 at an angle inclined relative to the axis of the drive shaft 6, which corresponds to a setting angle $\theta$ of the swash plate 7 relative to the drive shaft 6, as hereinafter described in detail.

According to this embodiment, the rear refrigerant gas introducing means 26 mainly comprises a rear low pressure chamber 28, a refrigerant gas flow deflecting protuberance 31, and a through hole 32. The rear low pressure chamber 28 is defined by a rear end wall 125'a of the partition member 125', the rear valve plate 3', and a partition wall 30 extending between the rear end wall 125'a and the rear valve plate 3' and formed integrally with the former. This low pressure chamber 28 is interposed between the swash plate chamber 125 and the rear suction chamber 115', and communicates with the latter through an opening 29 formed through the rear valve plate 3'. The refrigerant gas flow deflecting protuberance 31 is formed at the junction of the partition wall 30 with the partition member 125' in a manner projecting radially outwardly and obliquely into the suction passageway 123' in a direction reverse to that of the refrigerant gas flow. To be specific, the protuberance 31 extends rearward at a first predetermined angle $\alpha$ relative to the axis of the drive shaft 6.

The through hole 32 is formed at the base of the protuberance 31, i.e. at the junction of the partition member 125' with the partition wall 30, and has its axis inclined by the first predetermined angle $\alpha$ relative to the axis of the drive shaft 6. A communication hole 33 is formed through the rear end wall 125'a of the partition member 125' at a radially inward location thereof, to communicate the swash plate chamber 125 with the rear low pressure chamber 28.

The front refrigerant gas introducing means 27 comprises an opening 125'c formed through the peripheral wall of the partition member 125', a front low pressure chamber 35, and a refrigerant gas guide plate 38 formed integrally with the front half portion of the partition member 125'. The opening 125'c extends between the protuberance 31 and the guide plate 38. The front low pressure chamber 35 is defined by front end wall 125'b of the partition member 125', a radial partition wall 37 extending between the front end wall 125'b and the peripheral wall of the front cylindrical member 2, and the front valve plate 3, and is communicated with the front suction chamber 115 via an opening 36 formed through the front valve plate 3. The refrigerant gas guide plate 38 projects radially inwardly from the front half portion of the partition member 125' at an end portion thereof closer to the front side block 4, into the swash plate chamber 125 at a second predetermined angle $\alpha'$ relative to the axis of the drive shaft 6. A through hole 39 is formed in the front end wall 125'b of the partition member 125' at a location radially inward of the guide plate 38, to communicate the swash plate chamber 125 with the front low pressure chamber 35. The first and second predetermined angles $\alpha$, $\alpha'$ are set at values satisfying the relationships $\alpha<\theta$, and $\alpha'<\theta$, respectively.

With the swash-plate type compressor constructed as above, when the drive shaft 6 rotates to swingingly rotate the swash plate 7, the pistons 11 each reciprocate within the cylinder bore 10 to alternately increase and decrease the volume of two pump working chambers 14, 14' associated with each piston 11, thereby performing suction and compression of the refrigerant gas. During suction strokes of the pistons 11, the refrigerant gas in the suction chambers 115, 115' is sucked into the pump working chambers 14, 14', respectively, through the suction openings 17, 17'. Therefore, negative pressure is alternately produced in the low pressure chamber 28 and in the low pressure chamber 35 communicating, respectively, with the pump working chambers 14', 14.

As best shown in FIG. 4, part of the refrigerant gas introduced through the suction port 122 into the passage 123' via the through hole 3'a flows in the passage 123' at a location radially outward of the outer end of the refrigerant gas deflecting protuberance 31, and then flows along the upper surface of the peripheral wall of the partition member 125' toward the front side of the compressor. On the other hand, the remaining part of the refrigerant gas which flows radially inwardly of the outer end of the protuberance 31 collides with the protuberance 31 at its inclined surface facing toward the rear side block 4', to be deflected thereby and guided along the inclined surface into the through hole 32 extending at the first predetermined angle $\alpha$ relative to the axis of the drive shaft 6. Therefore, the refrigerant gas thus introduced into the through hole 32 flows obliquely into the swash plate chamber 125 toward the swash plate 7 from a portion of the passage 123' radially outward of the swash plate 7 at an angle substantially equal to the first predetermined angle $\alpha$ relative to the axis of the drive shaft 6, whereby introduction of the refrigerant gas into the swash plate chamber 125 is not impeded by the swinging rotation of the swash plate 7 but enhanced by negative pressure produced in the rear low pressure chamber 28 to the contrary, due to suction of the refrigerant gas into the pump working chamber 14. While the swash plate 7 swingingly rotates, the refrigerant gas thus introduced into the swash plate chamber 125 collides with the swash plate 7, the thrust bearings 9, 9', etc. to have lubricating oil separated therefrom, which lubricates the sliding contact portions of the swash plate 7, the pistons 11, the balls 12, 12' and the shoes 13, 13' as well as the thrust bearings 9, 9'. Thereafter, the refrigerant gas in the swash plate chamber 125 is delivered to the rear suction chamber 115' via the through hole 33, the rear low pressure chamber 28 and the opening 29.

The part of the refrigerant gas, which has flowed along the upper surface of the peripheral wall of the partition member 125' toward the front side of the compressor, is guided radially inwardly along the guide plate 38 located axially outward of the swash plate 7, as the passage 123' is closed by the partition wall 37, and is then forced to flow through the opening 125'c of the partition member 125' into the swash plate chamber 125 obliquely at an angle substantially equal to the second predetermined angle $\alpha'$ relative to the axis of the drive shaft 6, whereby introduction of the refrigerant gas into the swash plate chamber 125 is not impeded by the swinging rotation of the swash plate 7 but promoted by the negative pressure produced in the front low pressure chamber 35 to the contrary. While the swash plate 7 swingingly rotates, the lubricating oil is separated from the refrigerant gas and supplied to the swash plate 7, the thrust bearings 9, 9', etc. to lubricate same in a manner similar to that mentioned before. The refrigerant gas thus introduced into the swash plate chamber 125 is then guided through the through hole 39, the front low pressure chamber 35, and the opening 36 to the front suction chamber 115. The refrigerant gas in the front and rear suction chambers 115, 115' is then sucked into the respective associated pump working chambers 14, 14', compressed therein, and delivered to the external refrigerating circuit through the discharge chambers 116, 116'.

Figure 5:
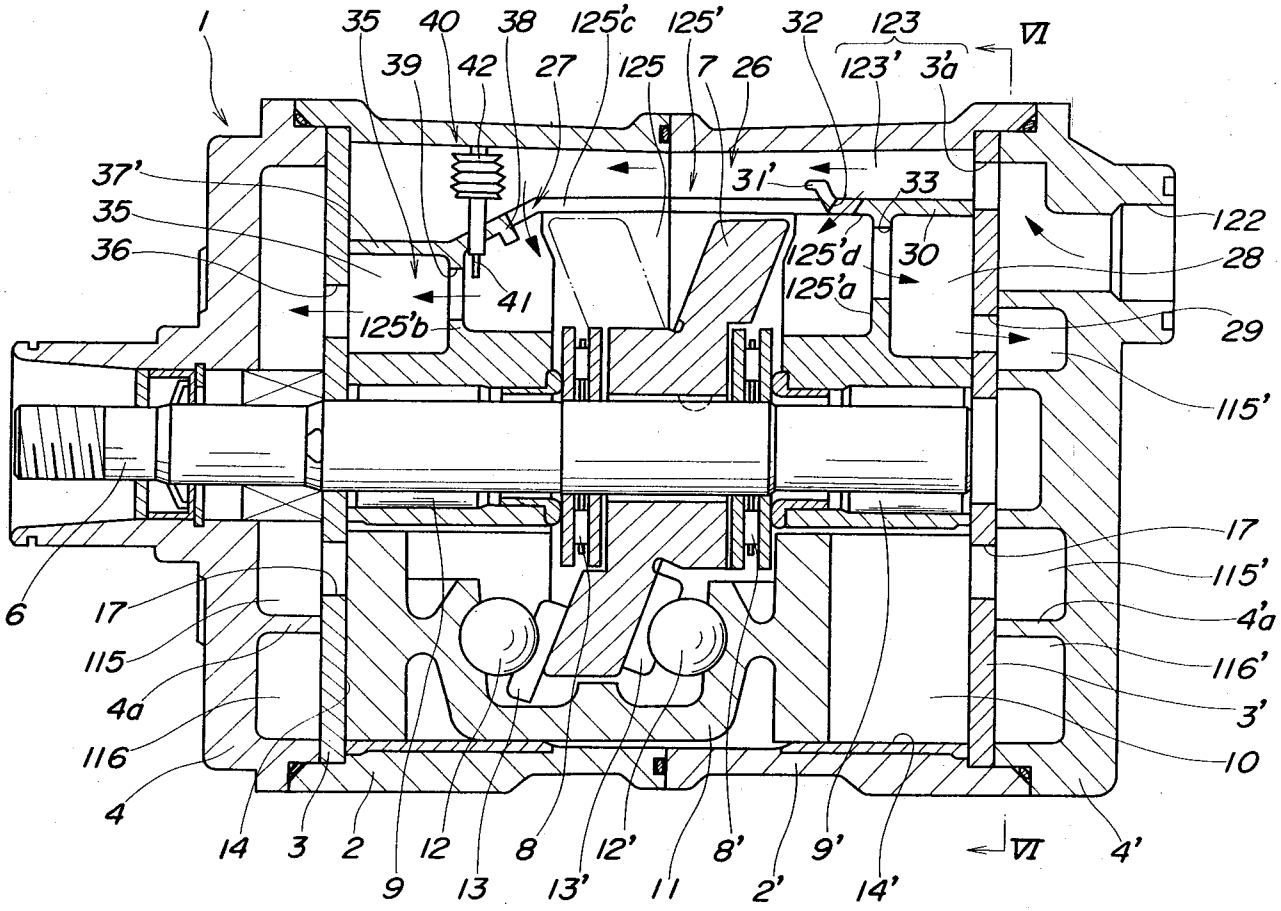
FIG. 5 is a vertical longitudinal sectional view of a swash-plate type compressor according to a second embodiment of the invention.
Figure 7:
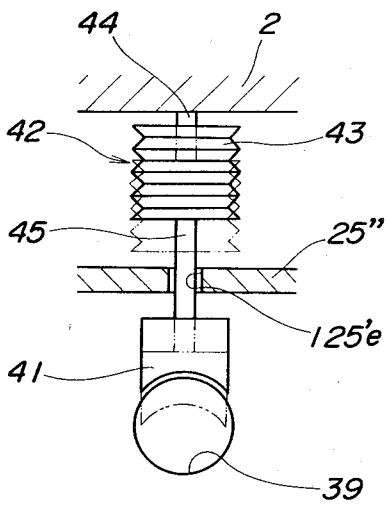
FIG. 7 is a fragmentary enlarged view illustrating a delivery control mechanism appearing in FIG. 5.
Figure 6:
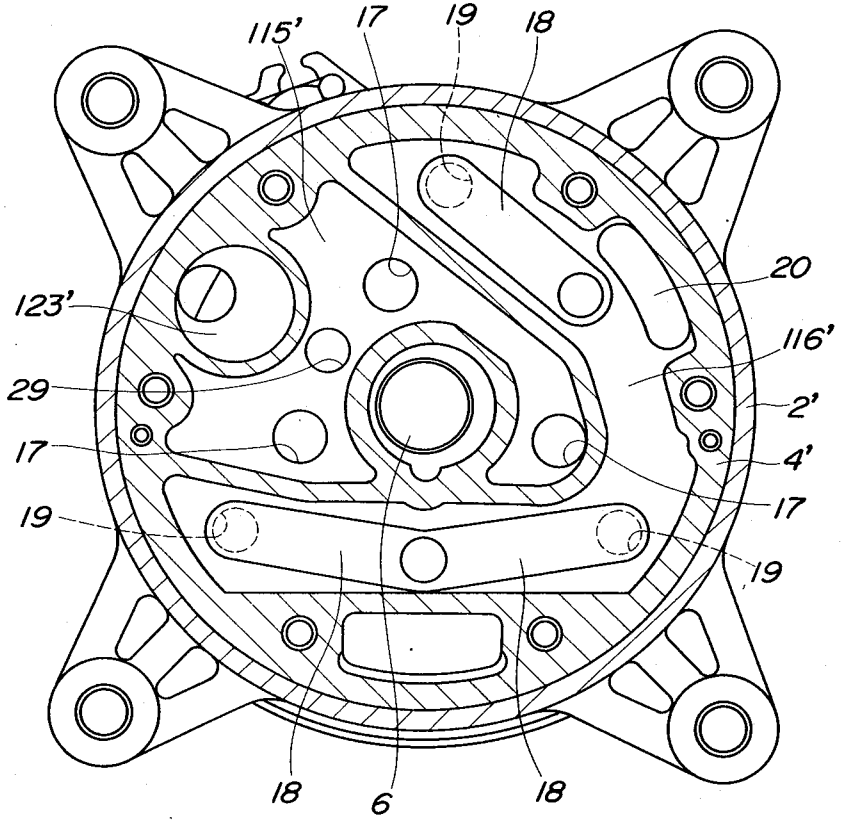
FIG. 6 is a vertical transverse cross-sectional view taken along line VI—VI in FIG. 5.

FIGS. 5 through 7 illustrate a swash-plate type compressor according to a second embodiment of the invention. This compressor has a construction substantially identical with that of the compressor according to the first embodiment of the invention, except that it includes a delivery control mechanism which varies the compressor delivery in response to the rotational speed of the compressor. Therefore, in these figures, like reference characters are used to designate parts and elements identical with those in the first embodiment, and explanation thereof in connection with their arrangement and operation is omitted.

According to this embodiment, the delivery control mechanism 40 varies the effective cross-sectional area of the communication hole 39 communicating the swash plate chamber 125 with the front suction chamber 115, and comprises a damper 41 and a pressure-responsive member 42 disposed to drive the damper 41.

The damper 41 is arranged in the swash plate chamber 125 at a location adjacent and opposite the communication hole 39, and comprises a generally plate-like member having its radially inner end 41*a* arcuately cut, as best shown in FIG. 7. The pressure-responsive member 42 includes, as best shown in FIG. 7, bellows 43 alternately expandable and contractible, arranged in a portion of the passage 123' closer to the front valve plate 3 and secured at its radially outward end to the inner peripheral wall of the front cylindrical member 2 via a rod 44. The other or radially inward end of the bellows 43 is secured to the damper 41 via a rod 45 extending through an opening 125'*e* formed through the front half portion of the partition member 125'. The bellows 43 has its interior filled with an inert gas so that it expands or contracts in response to the pressure of the refrigerant gas present in the passage 123'.

As distinct from the first embodiment, a partition wall 37' of the second embodiment, which defines part of the front low pressure chamber 35, extends parallel with the drive shaft 6 from the junction thereof with the front end wall 125'*b* of the partition member 125', and a refrigerant gas flow deflecting protuberance 31' extends from an end portion of the peripheral wall 125'*d* closer to the rear side block 4', substantially vertically with respect to the peripheral wall 125'*d* and then toward the front side block 4, while a through hole 32 is formed in the peripheral wall 125'*d* per se of the partition member 125'. However, these modifications are attributed to mere design choices and the required effects obtained by the first embodiment can also be achieved by the arrangement according to the second embodiment.

The swash-plate type compressor constructed as above, operates as follows: According to this compressor, in a manner similar to the first embodiment, when the drive shaft 6 rotates, the refrigerant gas is smoothly introduced into the swash plate chamber 125 by the refrigerant gas introducing means 26, 27, to lubricate the sliding contact portions of the compressor with a sufficient amount of the lubricating oil contained in the refrigerant gas.

Figure 8:
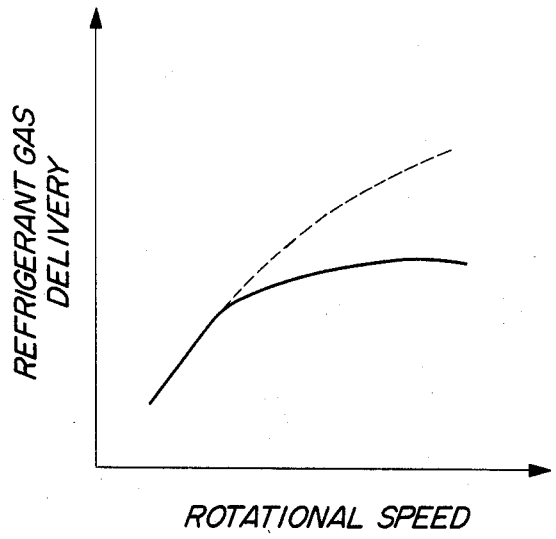
FIG. 8 is a graph showing, by way of example, a rotational speed-compressor delivery characteristic obtained by the compressor of FIG. 5.
Figure 9:
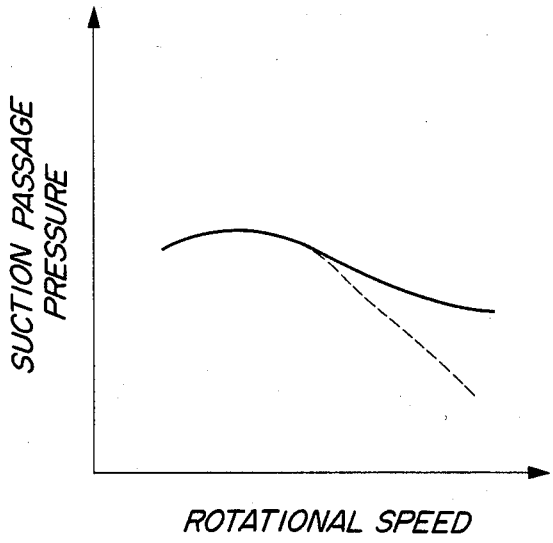
FIG. 9 is a graph showing, by way of example, a rotational speed-suction passageway pressure characteristic obtained by the compressor of FIG. 5.

Besides, the compressor according to the second embodiment is capable of varying the compressor delivery in response to the rotational speed of the compressor. To be specific, as the rotational speed of the compressor increases and accordingly the amount of refrigerant gas sucked into the pump working chambers 14, 14' increases, the pressure in the suction passageway 123 correspondingly decreases. The bellows 43 expands in response to the pressure decrease until it assumes a position where the pressure in the passage 123' and the internal pressure of the bellows 43 become equilibrated, as indicated by the two-dot chain line in FIG. 7, so that the damper 41 is displaced downward to reduce the effective cross-sectional area of the communication hole 39, thereby limiting the amount of the refrigerant gas to be introduced into the front suction chamber 115 through the hole 39. By virtue of this arrangement, as shown in FIG. 8, the amount of refrigerant gas discharged from the compressor more gently increases with an increase in the compressor rotational speed, as compared with a characteristic curve obtained by a compressor not provided with such a delivery control mechanism and indicated by the broken line in the same figure. Further, as the refrigerant gas flow is throttled by the damper 41 at the end portion of the swash plate chamber 125, the pressure in the suction passageway 123 is prevented from dropping abruptly with an increase in the rotational speed of the compressor, as indicated by the solid line in FIG. 9. In other words, even when the compressor operates at a high speed, a proper amount of the refrigerant gas can be introduced into the swash plate chamber 125 to supply a sufficient amount of lubricating oil to the swash plate 7, etc. Incidentally, the broken line in FIG. 9 denotes a rotational speed-suction passage pressure characteristic obtained by a compressor without a delivery control mechanism.

Although in the second embodiment, the communication hole 39 located on the front side of the compressor has its effective cross-sectional area varied by the damper 41, the communication hole 33 on the rear side or both the communication holes 39, 33 may alternatively have their effective cross-sectional areas varied by the dampers.

According to the arrangement of the invention, the refrigerant gas is introduced into the suction chambers 115, 115' through a long passageway formed by the suction port 122, the suction passageway 123, the swash plate chamber 125, the low pressure chambers 28, 35, etc., having cross-sectional areas different from each other. Therefore, pressure pulsations caused by reciprocating motions of the pistons 11 and transmitted into the suction chambers 115, 115' are attenuated to a substantially ineffective level before they reach to a pipe, not shown, connecting the suction port 122 to the refrigerating circuit, thereby preventing the pressure pulsations from causing vibrations of the compressor.

What is claimed is:

1. A swash-plate type compressor, comprising:

a main body including a cylinder block having at least one cylinder bore formed therein and axially extending therethrough, and a pair of side blocks secured to opposite ends of said cylinder block;

at least one double headed piston received within said at least one cylinder bore for reciprocating motion therein;

a pair of suction chambers formed in said main body at opposite ends thereof;

a suction passageway formed in said main body and axially extending therein, said suction passageway being disposed to be supplied with a refrigerant medium from outside and communicate with said at least one cylinder bore;

a drive shaft axially extending in said main body and supported for rotation therein;

a swash plate secured on said drive shaft obliquely relative to the shaft axis to define a first angle;

a swash plate chamber defined in said cylinder block at an axially central location thereof for accommodating said swash plate;

partition means for separating said suction passageway from said swash plate chamber, said partition means at least having first and second wall portions defining opposite end portions of said swash plate chamber, said suction chambers communicating with each other through said suction passageway and said swash plate chamber; and refrigerant medium introducing means arranged on at least one of said first and said second wall portions of said partition means, for introducing said refrigerant medium into said swash plate chamber toward said swash plate from a portion of said suction passageway radially outward of said swash plate substantially at a predetermined angle relative to the axis of said drive shaft;

wherein one of said paired side blocks has formed therein a suction port forming part of said suction passageway and disposed to be supplied with said refrigerant medium from outside, said refrigerant medium introducing means including first and second means, said first means including a refrigerant medium flow deflecting protuberance formed on said first wall portion of said partition means and projecting therefrom into said suction passageway, said first wall portion being arranged at a location close to said one side block, and a first through hole formed in said first wall portion at a location closer to said one side block with respect to said protuberance and closer to said one side block than said swash plate when said swash plate is in a first extreme position closest to said one side block, said through hole extending at a second angle relative to the axis of said drive shaft which second angle is more acute than said first angle relative to the drive shaft axis, and said second means including a refrigerant medium guiding member formed on said second wall portion of said partition means, said second wall portion being arranged at a location remote from said one side block, and a second through hole formed in said second wall portion having one end located closer to said other side block than said swash plate when said swash plate is in a second extreme position closest to said other side block, said guiding member extending from said second wall portion toward said swash plate chamber at a third angle relative to the axis of said drive shaft which third angle is more acute than said first angle relative to the drive shaft axis.

2. A swash-plate type compressor as claimed in claim 1, wherein said partition means has first and second through holes, respectively, formed in said first and second wall portions, and first and second partition walls, respectively, secured to said first and second wall portions, said first and second wall portions each defining in cooperation with a respective one of said first and second partition walls a low pressure chamber communicating with said swash plate chamber through a corresponding one of said first and second through holes, and also communicating with a corresponding one of said suction chambers.

3. A swash-plate type compressor, comprising:

a main body including a cylinder block having at least one cylinder bore formed therein and axially extending therethrough, and a pair of side blocks secured to opposite ends of said cylinder block;

at least one double headed piston received within said at least one cylinder bore for reciprocating motion therein;

a pair of suction chambers formed in said main body at opposite ends thereof;

a suction passageway formed in said main body and axially extending therein, said suction passageway being disposed to be supplied with a refrigerant medium from outside and communicate with said at least one cylinder bore;

a drive shaft axially extending in said main body and supported for rotation therein;

a swash plate secured on said drive shaft obliquely relative to the shaft axis;

a swash plate chamber defined in said cylinder block at an axially central location thereof for accommodating said swash plate;

partition means for separating said suction passageway from said swash plate chamber, said partition means at least having first and second wall portions defining opposite end portions of said swash plate chamber, said suction chambers communicating with each other through said suction passageway and said swash plate chamber; and refrigerant medium introducing means arranged on at least one of said first and said second wall portions of said partition means, for introducing said refrigerant medium into said swash plate chamber toward said swash plate from a portion of said suction passageway radially outward of said swash plate substantially at a predetermined angle relative to the axis of said drive shaft;

wherein one of said paired side blocks has formed therein a suction port forming part of said suction passageway and disposed to be supplied with said refrigerant medium from outside, said refrigerant medium introducing means including first and second means, said first means including a refrigerant medium flow deflecting protuberance formed on said first wall portion of said partition means and projecting therefrom into said suction passageway, said first wall portion being arranged at a location close to said one side block, and a first through hole formed in said first wall portion at a location closer to said one side block with respect to said protuberance and extending at a first predetermined angle relative to the axis of said drive shaft, said second means including a refrigerant medium guiding member formed on said second wall portion of said partition means, said second wall portion being arranged at a location remote from said one side block, said guiding member extending from said second wall portion toward said swash plate chamber at a second predetermined angle relative to the axis of said drive shaft;

wherein said partition means has first and second through holes, respectively, formed in said first and second wall portions, and frist and second partition walls, respectively, secured to said first and second wall portions, said first and second wall portions each defining in cooperation with a respective one of said first and second partition walls a low pressure chamber communicating with said swash plate chamber through a corresponding one of said first and second through holes, and also communicating with a corresponding one of said suction chambers; and delivery control means comprising a damper and a pressure-responsive member operatively connected to said damper, said damper being arranged adjacent and opposite one of said first and second through holes formed in said first and second wall portions of said partition means, said pressure-responsive member being arranged in said suction passageway and adapted to displace said damper to vary the effective cross-sectional area of said one of said first and second through holes in response to the internal pressure of said suction passageway.

4. A swash-plate type compressor as claimed in claim 3, wherein said pressure-responsive member is adapted to displace said damper to decrease the effective cross-sectional area of said one of said first and second through holes with a decrease in the internal pressure of said suction passageway.

5. A swash-plate type compressor according to claim 3, wherein said suction passageway has its end portion which is closer to said other side block closed by a part of said second partition wall.

* * * * *